US010024207B2

(12) United States Patent
Celata et al.

(10) Patent No.: US 10,024,207 B2
(45) Date of Patent: Jul. 17, 2018

(54) VARIABLE DISPLACEMENT LUBRICANT PUMP

(71) Applicant: PIERBURG PUMP TECHNOLOGY GMBH, Neuss (DE)

(72) Inventors: Nicola Celata, Leghorn (IT); Maurizio Moriglia, Mondovi (IT); Andrea Malotti, Cecina (IT); Nicola Novi, Pisa (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 345 days.

(21) Appl. No.: 14/893,529

(22) PCT Filed: May 24, 2013

(86) PCT No.: PCT/EP2013/060752
§ 371 (c)(1),
(2) Date: Nov. 24, 2015

(87) PCT Pub. No.: WO2014/187503
PCT Pub. Date: Nov. 27, 2014

(65) Prior Publication Data

US 2016/0115832 A1 Apr. 28, 2016

(51) Int. Cl.

| | |
|---|---|
| ***F04C 14/18*** | (2006.01) |
| ***F01M 1/16*** | (2006.01) |
| ***F04C 2/344*** | (2006.01) |
| ***F04C 14/22*** | (2006.01) |

(Continued)

(52) U.S. Cl.
CPC ..... *F01M 1/16* (2013.01); *F01M 1/02* (2013.01); *F04C 2/3442* (2013.01); *F04C 14/22* (2013.01);

(Continued)

(58) Field of Classification Search
CPC ..... F01M 1/16; F01M 1/02; F04C 2/3442; F04C 14/24; F04C 14/22; F04C 2270/58;

(Continued)

(56) References Cited

U.S. PATENT DOCUMENTS 8,047,822 B2 * 11/2011 Shulver ..... F01M 1/16 417/220
8,512,006 B2 * 8/2013 Hunter ..... F04C 2/3442 417/212

(Continued)

FOREIGN PATENT DOCUMENTS

CN 102844570 A 12/2012
DE 10 2008 048 856 A1 4/2010

(Continued)

*Primary Examiner* — Charles Freay
(74) *Attorney, Agent, or Firm* — Norman B. Thot

(57) ABSTRACT

A lubricant pump comprises a shiftable control ring, a pump rotor rotating in the control ring, a pump outlet, and a pressure control system. The pressure control system comprises a pressure control chamber which pushes the control ring into a high pumping volume direction, an engine pressure input port connected to an engine pressure output port of an engine, a pilot chamber connected to the engine pressure input port which pushes the control ring into a low pumping volume direction, and a pressure control valve which controls a pressure in the pressure control chamber. The pressure control valve comprises a control valve plunger which opens/closes a control port to connect/disconnect the pressure control chamber to the atmospheric. The control valve plunger is fluidically connected to the engine pressure input port so that the control valve plunger is pushed by a lubricant pressure of the engine into an open position.

5 Claims, 2 Drawing Sheets

(51) Int. Cl.
*F04C 14/24* (2006.01)
*F01M 1/02* (2006.01)

(52) U.S. Cl.
CPC ..... *F04C 14/24* (2013.01); *F04C 2240/20* (2013.01); *F04C 2270/185* (2013.01); *F04C 2270/58* (2013.01)

(58) Field of Classification Search
CPC ..... F04C 2240/20; F04C 2270/185; F04C 14/223; F04C 14/226
USPC ..... 417/30, 31; 418/220
See application file for complete search history.

(56) References Cited

U.S. PATENT DOCUMENTS

| | | | | |
|---|---|---|---|---|
| 2005/0129528 | A1 | 6/2005 | Hunter et al. | |
| 2008/0038117 | A1* | 2/2008 | Armenio ..... | F04C 2/3442 417/26 |
| 2010/0271126 | A1* | 10/2010 | Wang ..... | H03F 3/45475 330/185 |
| 2013/0039790 | A1 | 2/2013 | Cuneo et al. | |
| 2014/0030120 | A1 | 1/2014 | Cuneo | |

FOREIGN PATENT DOCUMENTS

| | | | |
|---|---|---|---|
| EP | 1 522 732 | A2 | 4/2005 |
| JP | 59-70891 | * | 4/1984 |
| WO | WO 94/17308 | * | 8/1994 |
| WO | WO 2005/026553 | A1 | 3/2005 |
| WO | WO 2012/113437 | A1 | 8/2012 |

* cited by examiner

VARIABLE DISPLACEMENT LUBRICANT PUMP

CROSS REFERENCE TO PRIOR APPLICATIONS

This application is a U.S. National Phase application under 35 U.S.C. § 371 of International Application No. PCT/EP2013/060752, filed on May 24, 2013. The International Application was published in English on Nov. 27, 2014 as WO 2014/187503 A1 under PCT Article 21(2).

FIELD

The present invention relates to a variable displacement lubricant pump for providing a pressurized lubricant for an internal combustion engine.

BACKGROUND

The lubricant pump is a mechanical pump which is mechanically driven by the engine. The lubricant pump is fluidically coupled to the combustion engine for pumping a pressurized lubricant to and through the engine.

WO 2012/113437 describes a variable lubricant pump with a pump rotor with radially slidable vanes which rotate inside a shiftable control ring, which is radially shiftable or pivotable with respect to the rotor axis, between a high pumping volume position and a low pumping volume position. The pump comprises a pressure control system to control the discharge pressure of the pressurized lubricant at the pump outlet. The pressure control system comprises a fluidic pressure control chamber to push the shiftable control ring into a high pumping volume direction. The pressure control system also comprises a fluidic pilot chamber to push the control ring into a low pumping volume direction against the forces generated by the pressure control chamber. The pressure control chamber is an antagonist of the pilot chamber. The pilot chamber and the control chamber are directly fluidically connected to the discharge pressure.

The pressure control chamber is also fluidically connected to atmospheric pressure via a pressure control valve which controls the pressure in the pressure control chamber. The pressure control valve is provided with a control valve plunger to open and close a control port of the control valve. The control port of the pressure control valve is connected to an outlet of the pressure control chamber so that the pressure control chamber is connected to atmospheric pressure in the open valve position of the pressure control valve. The pressure control chamber is connected to the discharge pressure in the closed valve position of the pressure control valve. This control arrangement provides short fluidic paths so that the control quality and control stability is high. The discharge pressure of the pump is controlled and kept stable, however, it is the lubricant pressure in or at the engine actually which is the process variable that is relevant and important for a sufficient lubrication of the engine.

DE 10 2008 048 856 A1 describes a similar arrangement with a variable displacement lubricant pump. The pressure control valve is not controlled by the discharge pressure, but is controlled by the engine's lubricant pressure. Practice has shown that a lubricant pump with this control arrangement can cause pressure pulsation and flow rate pulsation. These kinds of pulsations cause performance losses of the lubricant pump and also cause unnecessary wear.

SUMMARY

An aspect of the present invention is to provide a variable displacement lubricant pump with a high control quantity.

In an embodiment, the present invention provides a variable displacement lubricant pump which is fluidically coupled to and which is configured to be mechanically driven by an internal combustion engine for pumping a pressurized lubricant to the internal combustion engine. The variable displacement lubricant pump comprises a control ring configured to be shiftable or pivotable with respect to a rotor axis between a high pumping volume position and a low pumping volume position, a pump rotor comprising vanes configured to be radially slidable, a pump outlet, and a pressure control system configured to control a discharge pressure of a lubricant leaving the variable displacement lubricant pump via the pump outlet. The pump rotor is configured to rotate in the control ring. The pressure control system comprises a pressure control chamber configured to push the control ring into the high pumping volume direction, an engine pressure input port connected to an engine pressure output port of the internal combustion engine, a pilot chamber configured to push the control ring into the low pumping volume direction against the pressure control chamber, the pilot chamber being connected to the engine pressure input port, and a pressure control valve configured to control a pressure in the pressure control chamber. The pressure control valve comprises a control port, and a control valve plunger configured to open and to close the control port so as to connect or to disconnect the pressure control chamber to atmospheric pressure. The control valve plunger is fluidically connected to the engine pressure input port so that the control valve plunger is pushed by a lubricant pressure of the internal combustion engine into an open position.

BRIEF DESCRIPTION OF THE DRAWINGS

The present invention is described in greater detail below on the basis of embodiments and of the drawings in which.

DETAILED DESCRIPTION

The variable displacement lubricant pump of the present invention is provided with an engine pressure input port which can be connected to an engine pressure output port of the engine so that the lubricant pressure pa at or in the engine is available at the lubricant pump to control the discharge pressure pd of the lubricant pump. The control valve plunger is fluidically connected to the engine pressure input port so that the control valve plunger is pushed by the engine lubricant pressure pe into the open position in which the pressure control chamber is connected to atmospheric pressure pa. The pilot chamber is also directly connected to the engine pressure input port so that the pilot chamber is controlled and driven by the engine's lubricant pressure pe, and not by the discharge pressure pd. As a consequence, no relevant phase shift exists between the pressures directed to the pilot chamber and to the control valve plunger, so that the pressure control of the lubricant pump becomes stable and pulsations of the discharge pressure and the discharge flow can be avoided. This results in a higher control quality of the engine's lubricant pressure, a reduced performance loss, and an increased lifetime of the lubricant pump.

In an embodiment of the present invention, the pressure control chamber can, for example, also be connected to the engine pressure input port so that the pressure control chamber is no longer directly connected to the discharge pressure. All three control elements which effect the position of the shiftable control ring are therefore driven by the engine's lubricant pressure pe so that no relevant phase shift of the pressure signals affecting the control elements can occur.

In an embodiment of the present invention, the control ring can, for example, be pretensioned by a pretension spring into the high pumping volume direction. The pretension spring is an antagonist of the pilot chamber.

In an embodiment of the present invention, the control valve plunger can, for example, be pretensioned by a separate control valve plunger spring into the closed position of the control valve plunger. The control valve plunger spring acts as an antagonist of the engine's lubricant pressure pe pushing the control valve plunger into the open position.

Two embodiments of the present invention are described below with reference to the drawings.

Figure 1:
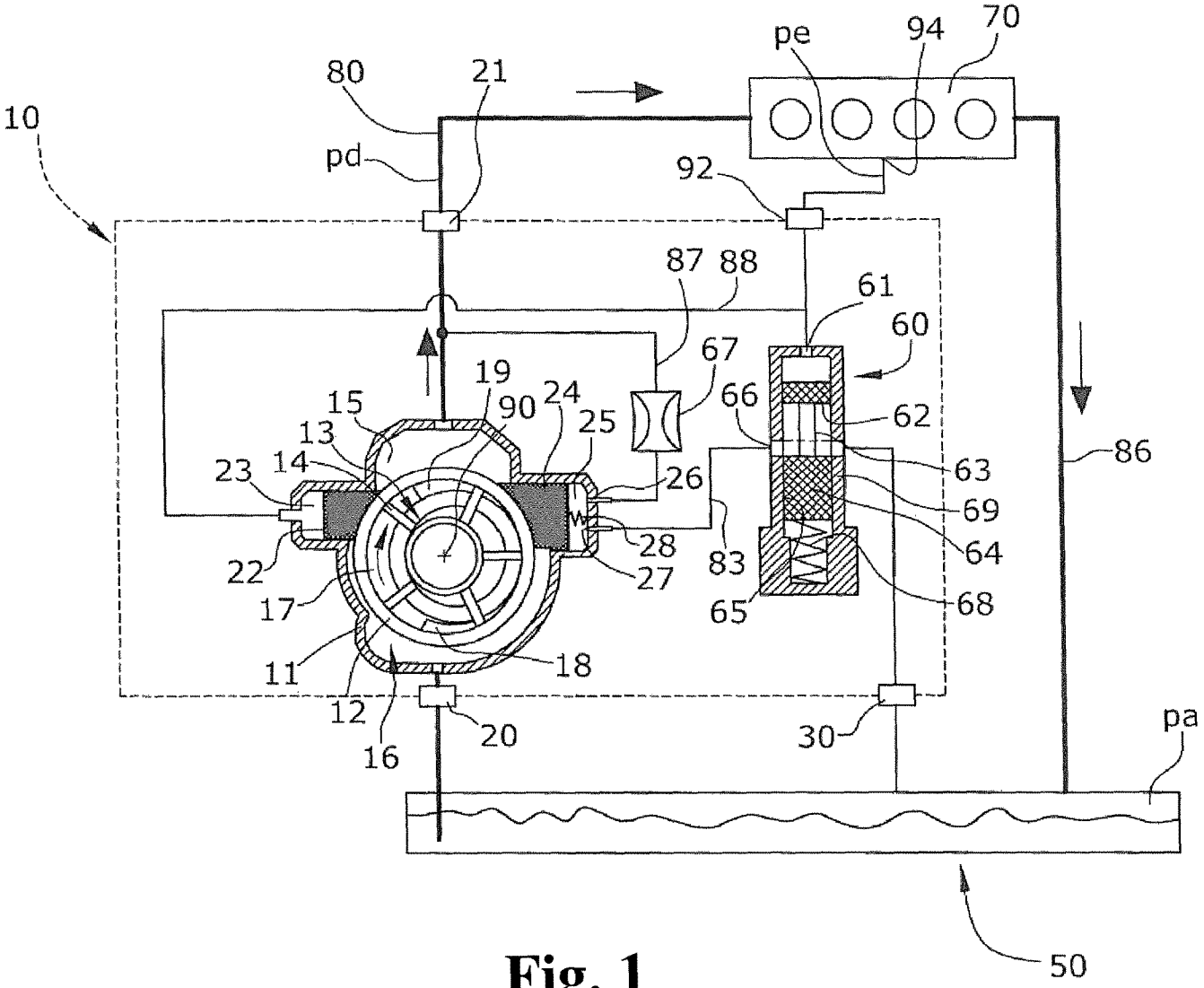
FIG. 1 shows a first arrangement of a variable displacement lubricant pump together with an internal combustion engine, wherein the control valve and the pilot chamber are actuated by the engine's lubricant pressure pe.
Figure 2:
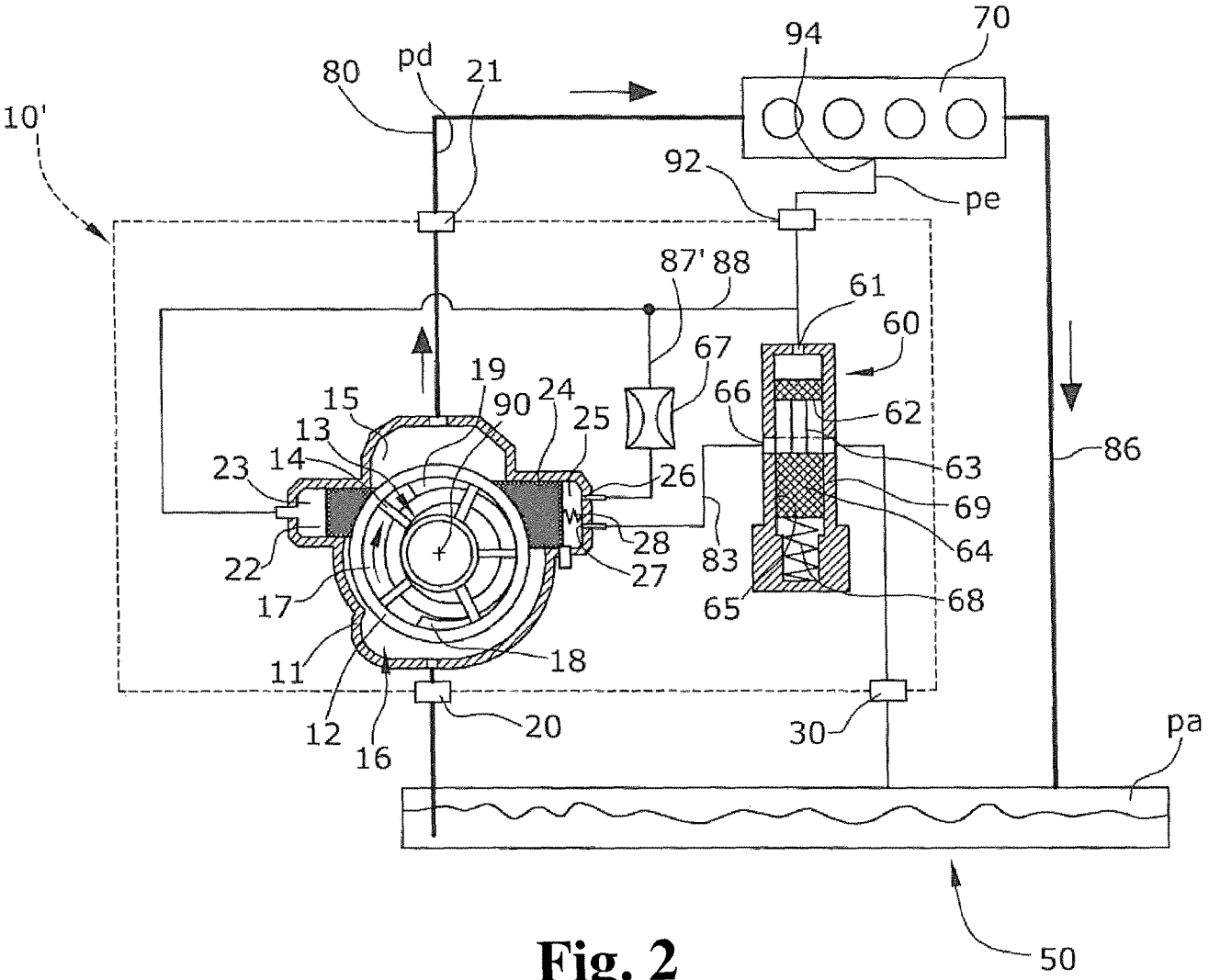
FIG. 2 shows a second arrangement of a variable displacement lubricant pump together with an internal combustion engine, wherein the control valve, the pilot chamber, and the pressure control chamber are actuated by the engine's lubricant pressure pe.

FIGS. 1 and 2 show schematic representations of an lubricant circuit arrangement including a variable displacement lubricant pump 10 and an internal combustion engine 70 both defining the relevant elements of the lubricant circuit. The lubricant pump 10 is mechanically driven by the engine 70 so that the rotational speed of the lubricant pump 10 is proportional to the rotational speed of the engine 70. The lubricant pump 10 sucks lubricant from a lubricant tank 50 through a pump inlet 20, and pumps pressurized lubricant with a discharge pressure pd through a pump outlet 21 and a lubricant supply line 80 to the engine 70. Inside the engine 70, the lubricant has an engine lubricant pressure pe which is less than the pump's discharge pressure pd. The lubricant flows from the engine 70 through a return line 86 back to the lubricant tank 50, where the lubricant is under atmospheric pressure pa.

The lubricant pump 10 comprises a pump housing 11 defining a cavity 16 wherein a pump rotor 13 with radially slidable vanes 14 rotates within a shiftable control ring 12. The pump housing 11 is closed by two pump side walls 15 (one of which is not shown in the drawings). The pump side walls 15, the vanes 14, the pump rotor 13, and the control ring 12 define five rotating pump chambers 17. One of the side walls 15 is provided with a pump chamber inlet opening 18 and with a pump chamber outlet opening 19 through which the lubricant flows into the rotating pump chambers 17 and out of the rotating pump chambers 17.

The control ring 12 is linear shiftable so that the eccentricity of the control ring 12 with respect to the rotation axis 90 of the pump rotor 13 can be set to thereby shift the control ring 12 between a low pumping volume, at low eccentricity position, and a high pumping volume position, at high eccentricity, as shown in FIGS. 1 and 2.

The control ring 12 is provided with a first control ring plunger 24 housed in part in a pressure control chamber 25 and is provided with a second control ring plunger 22 housed in part in a pilot chamber 23 opposite to the pressure control chamber 25. The pressure control chamber 25 and the pilot chamber 23 are defined by the pump housing 11 and are antagonists. The control ring 12 and the plungers 22, 24 are provided as one single integral part.

The control ring 12 is mechanically pretensioned by a pretension spring 28 located inside the pressure control chamber 25 into the high pumping volume direction. The pretension spring 28 and the pressure control chamber 25 both are antagonists of the pilot chamber 23.

The pressure control chamber 25 is fluidically connected by an internal pressure line 87 including a pressure throttle valve 67 with the discharge pressure pd. The lubricant can flow through the internal pressure line 87 via the pressure throttle valve 67 and through a control chamber inlet 26 into the pressure control chamber 25 so that a calibrated pressure drop occurs at the pressure throttle valve 67 as long as the lubricant flows through the pressure throttle valve 67 to the pressure control chamber 25. If the lubricant is not flowing through the internal pressure line 87, the lubricant pressure inside the pressure control chamber 25 is more or less equal to the discharge pressure pd.

The pressure control chamber 25 is also provided with a control chamber outlet 27 which is fluidically connected via an internal control line 83 with a control port 66 of a pressure control valve 60. The pressure control valve 60 keeps the engine's lubricant pressure pe more or less at a constant nominal pressure value independently of the rotational speed of the engine 70 and the lubricant pump 10 by controlling the position of the control ring 12.

The pressure control valve 60 is provided with a cylindrical control valve housing 69 with a shiftable plunger arrangement which is provided with an input pressure plunger 62, a control valve plunger 64, and a plunger shaft 63 mechanically connecting the input pressure plunger 62 and the control valve plunger 64. The plunger arrangement including the control valve plunger 64 is shiftable between an open position, as shown in FIGS. 1 and 2, and a closed position. In the open position, the pressure control chamber 25 is fluidically connected via the control port 66 and a pump control outlet 30 with the lubricant tank 50, which is under atmospheric pressure pa.

The position of the plunger arrangement including the control valve plunger 64 is determined by a control valve plunger spring 68 which pretensions the control valve plunger 64 into the closed position and by the fluidic pressure acting against the input pressure plunger 62.

The lubricant pump 10 is provided with an engine pressure input port 92 which is fluidically connected by an internal lubricant line with a control pressure input 61 of the pressure control valve 60 so that the input pressure plunger 62 is loaded with the engine's lubricant pressure pe. The engine pressure input port 92 is also connected to an engine pressure output port 94 of the engine 70. The force generated by the engine's lubricant pressure pe acting against the input pressure plunger 62 acts against the force generated by the control valve plunger spring 68.

The pilot chamber 23 is also fluidically connected via an internal lubricant line 88 with the engine pressure input port 92 of the lubricant pump 10 so that, in the pilot chamber 23, the engines lubricant pressure pe is always present pushing the second control ring plunger 22 into the low pumping volume direction.

In the embodiment shown in FIG. 1, the engine's lubricant pressure pe is directed to the pilot chamber 23 and to the pressure control valve 60, whereas the pressure control chamber 25 is fluidically connected to the pump outlet 21.

In the embodiment shown in FIG. 2, the pressure control chamber 25 is also fluidically connected to the engine pressure input port 92 via an internal line 87' so that the pressure control chamber 25 is loaded with the engine's lubricant pressure pe and reaches the pressure pe if the pressure control valve 60 is closed.

The control characteristics of the lubricant pump 10 are improved significantly as a result because pressure pulsations and flow pulsations can be avoided.

The present invention is not limited to embodiments described herein; reference should be had to the appended claims.

What is claimed is:

1. A variable displacement lubricant pump fluidically coupled to and being configured to be mechanically driven by an internal combustion engine for pumping a pressurized lubricant to the internal combustion engine, the variable displacement lubricant pump comprising:

a control ring configured to be shiftable or pivotable with respect to a rotor axis between a high pumping volume position and a low pumping volume position;

a pump rotor comprising vanes configured to be radially slidable, the pump rotor being configured to rotate in the control ring;

a pump outlet; and a pressure control system configured to control a discharge pressure of a lubricant leaving the variable displacement lubricant pump via the pump outlet, the pressure control system comprising:

a pressure control chamber configured to push the control ring into a high pumping volume direction, an engine pressure input port connected to an engine pressure output port of the internal combustion engine, a pilot chamber configured to push the control ring into a low pumping volume direction against the pressure control chamber, the pilot chamber being connected to the engine pressure input port, and a pressure control valve configured to control a pressure in the pressure control chamber, the pressure control valve comprising, a control port, and a control valve plunger configured to open and to close the control port so as to connect or to disconnect the pressure control chamber to atmospheric pressure, wherein, the control valve plunger is fluidically connected to the engine pressure input port so that the control valve plunger is pushed by a lubricant pressure of the internal combustion engine into an open position, a lubricant pressure of the internal combustion engine is directed only to the pilot chamber and to the pressure control valve, and the pressure control chamber is fluidically connected to the pump outlet by an internal pressure line which comprises a pressure throttle valve.

2. The variable displacement lubricant pump as recited in claim 1, wherein the pressure control chamber is connected to the engine pressure input port.

3. The variable displacement lubricant pump as recited in claim 1, further comprising a pretension spring configured to pretension the control ring into the high pumping volume direction.

4. The variable displacement lubricant pump as recited in claim 1, wherein the pressure control valve further comprises a pressure control valve plunger spring which is configured to pretension the control valve plunger into a closed position.

5. The variable displacement lubricant pump as recited in claim 1, wherein a lubricant pressure inside the pressure control chamber is substantially equal to the discharge pressure of the lubricant leaving the variable displacement lubricant pump via the pump outlet.

* * * * *